United States Patent [19]

Murray

[11] Patent Number: 4,957,221

[45] Date of Patent: Sep. 18, 1990

[54] AIR TIGHT STORAGE SILO

[75] Inventor: Stuart W. Murray, Edmond, Okla.

[73] Assignee: CMI Corporation, Oklahoma City, Okla.

[21] Appl. No.: 292,904

[22] Filed: Jan. 3, 1989

[51] Int. Cl.[5] ..... B65D 85/00

[52] U.S. Cl. ..... 222/129; 222/152; 222/185; 222/450; 222/482; 222/485; 222/505; 222/558; 414/292; 251/56; 251/300; 137/869

[58] Field of Search ..... 222/129, 152, 185, 478, 222/481–485, 488, 448, 450, 477, 556, 558, 505; 251/56, 187, 300; 137/869; 414/292

[56] References Cited

U.S. PATENT DOCUMENTS

| | | | |
|---|---|---|---|
| 1,553,361 | 9/1925 | Butler | 222/129 |
| 1,571,544 | 2/1926 | Garlinghouse et al. | 222/129 |
| 2,293,160 | 8/1942 | Miller et al. | 222/185 X |
| 2,550,608 | 4/1951 | Shotwell | 222/185 X |
| 2,594,072 | 4/1952 | Ridley | 222/185 X |
| 2,663,466 | 12/1953 | Heltzel | 222/558 X |
| 2,742,324 | 4/1956 | Kerensky | 251/300 X |
| 2,774,515 | 12/1956 | Johansson et al. | 222/185 |
| 2,949,275 | 8/1960 | Pro | 222/450 |
| 3,348,739 | 10/1967 | Brock | 222/146 |
| 3,495,805 | 2/1970 | Steckle | 251/187 |
| 3,532,252 | 10/1970 | Brock | 222/52 |
| 3,802,582 | 4/1974 | Brock | 214/17 |
| 3,998,362 | 12/1976 | Lapierre et al. | 222/185 |
| 4,200,208 | 4/1980 | Hassenauer | 222/556 X |
| 4,206,571 | 6/1980 | Kramer et al. | 222/556 X |
| 4,249,679 | 2/1981 | Dillman | 222/542 |
| 4,288,060 | 9/1981 | Mittell | 251/56 X |
| 4,299,338 | 11/1981 | Jain et al. | 222/558 X |
| 4,306,828 | 12/1981 | Legille et al. | 251/158 X |

FOREIGN PATENT DOCUMENTS

| | | | |
|---|---|---|---|
| 946324 | 4/1974 | Canada | 222/152 |
| 812296 | 8/1951 | Fed. Rep. of Germany | 222/185 |
| 185217 | 4/1956 | Fed. Rep. of Germany | 222/129 |
| 2814486 | 12/1978 | Fed. Rep. of Germany | 222/185 |
| 1221073 | 3/1986 | U.S.S.R. | 222/556 |

OTHER PUBLICATIONS

Bituma-Stor, Brochure, Stationary Surge-Storage Systems, Undated.

*Primary Examiner*—Joseph J. Rolla
*Assistant Examiner*—Boris Milef
*Attorney, Agent, or Firm*—Dunlap, Copping, Peterson & Lee

[57] ABSTRACT

A improved silo is provided having a pair of pivoting receiver gates overlying a pair of receiver openings and a pair of pivoting discharge gates overlying a pair of discharge openings. A deformable seal is secured to the silo between the receiver openings and the receiver gates and between the discharge openings and the discharge gates. The gates are vertically adjusted by an eccentric assembly to compress the respective deformable seal for forming an air tight barrier between the respective openings and the gate.

11 Claims, 7 Drawing Sheets

AIR TIGHT STORAGE SILO

BRIEF SUMMARY OF THE INVENTION

1. Field of Invention.

The present invention relates generally to storage silos.

2. Background of the Invention.

The present invention provides an economical and efficient system for creating an air tight seal at the discharge and receiver openings of a storage silo. The present invention further provides an efficient system for reducing the effect of particle segregation occurring in a silo-stored material composed of particles varying in size.

Generally, when constructing air tight storage silos, elaborate sealing systems above or below the silo gates are employed. In some instances, these sealing systems include a separate floor having an gate system adjacent the silo gates. In other instances, the sealing systems may included a grease injection apparatus for applying grease between the silo gate and the silo. In either case, these systems generally increase the cost and weight of the silo.

Further, when storing a composition having a range of particle sizes in the silo, a uniform mass flow of the composition through the silo is inhibited. As the composition is withdrawn from the silo, segregation of the components may occur within the silo. This may result in an uneven delivery of the composition from the silo.

This invention comprises a silo having an improved air barrier system. The air barrier system of this invention includes a vertically adjustable silo gate and a deformable seal disposed between the silo and the gate. An air tight seal is formed by compressing the deformable seal between the silo and the gate.

The present invention further comprises a silo having a pair of side-by-side rectangular discharge openings and a pair of side-by-side rectangular receiver openings. The discharge and receiver openings are positioned in a perpendicularly overlapping manner. By feeding the composition into the silo through a rectangular receiver opening and extracting the composition through a rectangular discharge opening positioned 90° with respect to the receiver opening, the segregation pattern of the composition is disturbed as the composition is discharged from the silo. In this way, the effect of segregation occurring within the composition traveling the length of the silo is reduced and a more uniform delivery of the composition from the silo is achieved.

BRIEF DESCRIPTION OF THE DRAWINGS

FIG. 8 is a fragmented end elevational view of a pair of receiver gates secured to the silo.

FIG. 9 is a fragmented side elevational view of a portion of the support structure of a receiver gate secured to the eccentric assembly.

DETAILED DESCRIPTION OF THE DRAWINGS

Figure 1:
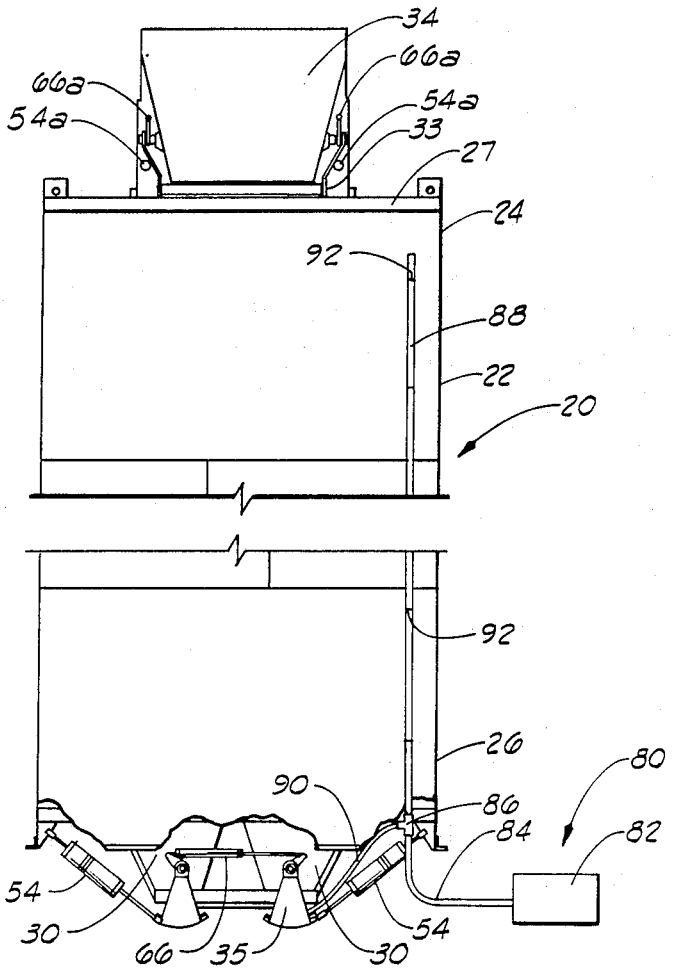
FIG. 1 is a front elevational view of a silo constructed in accordance with the invention with portions broken away to show some internal structure.

Referring to the drawings in detail, and particularly to FIG. 1, the present invention comprises a silo designated generally by the reference numeral 20. The silo 20 includes a vertically extending vessel 22 having an upper end 24 and a lower end 26.

Figure 13:
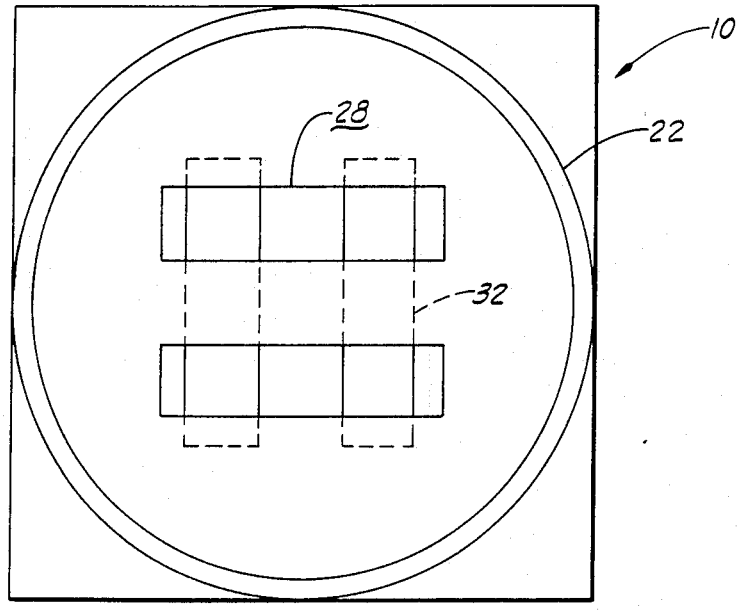
FIG. 13 is a schematic top plan view of the silo with the batcher removed, illustrating the overlapping relationship between the receiver openings and the discharge openings.

An upper floor 27, having a pair of side-by-side rectangular receiver openings 28 (FIG. 13), is secured to the upper end 24. The lower end 26 of the vessel 22 is further defined by a pair of flat-sided, side-by-side frustoconical hoppers 30, each having a rectangular discharge opening 32 (FIG. 13).

A pair of receiver gate assemblies 33 is secured to a batcher 34 positioned above the upper floor 27 for selectively opening and closing the respective receiver openings 28. A pair of discharge gate assemblies 35 is secured to the lower end 26 of the silo 20, for selectively opening and closing the respective discharge openings 32.

Figure 2:
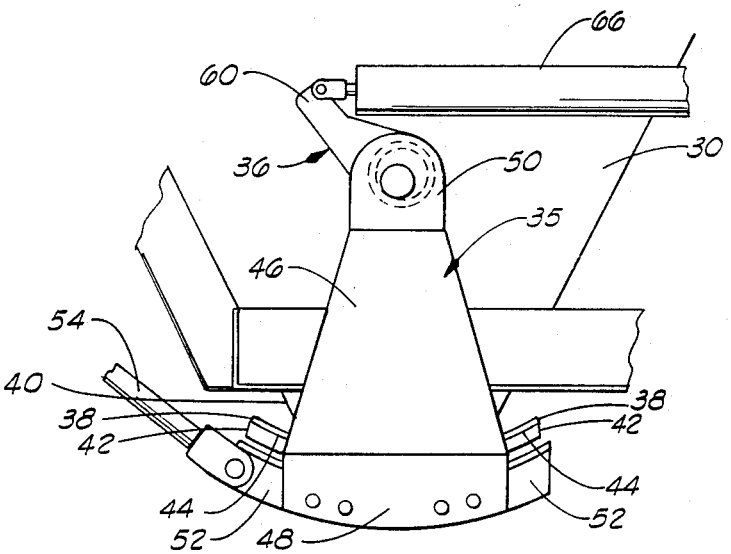
FIG. 2 is an enlarged end elevational view of a silo discharge gate and associated apparatus.
Figure 5:
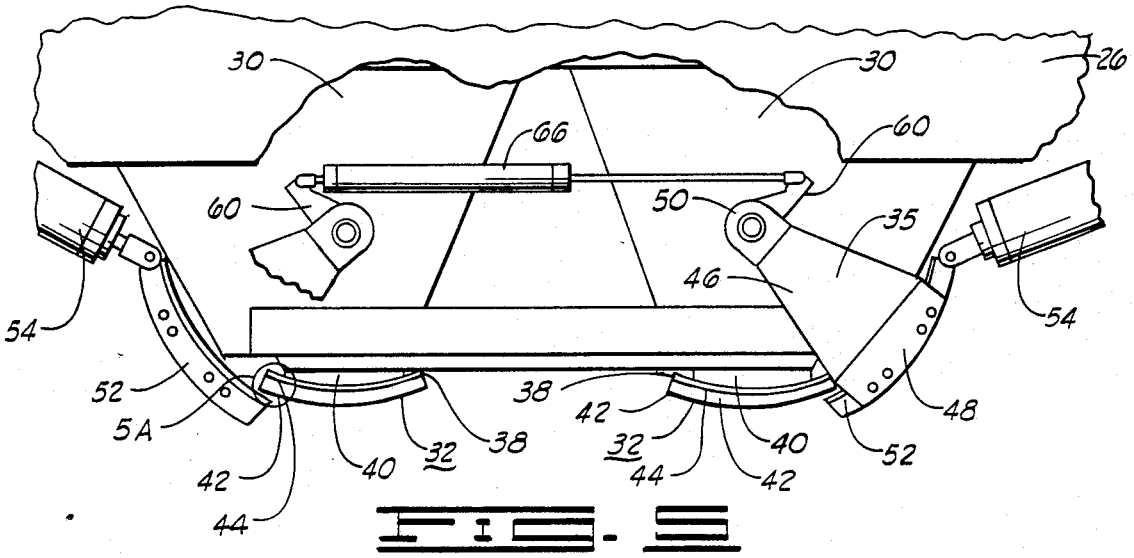
FIG. 5 is a fragmented end elevational view of a pair of discharge gates in an open position with the left hand gate arm broken away for clarity of illustration.
Figures 5A, 10A, 14:
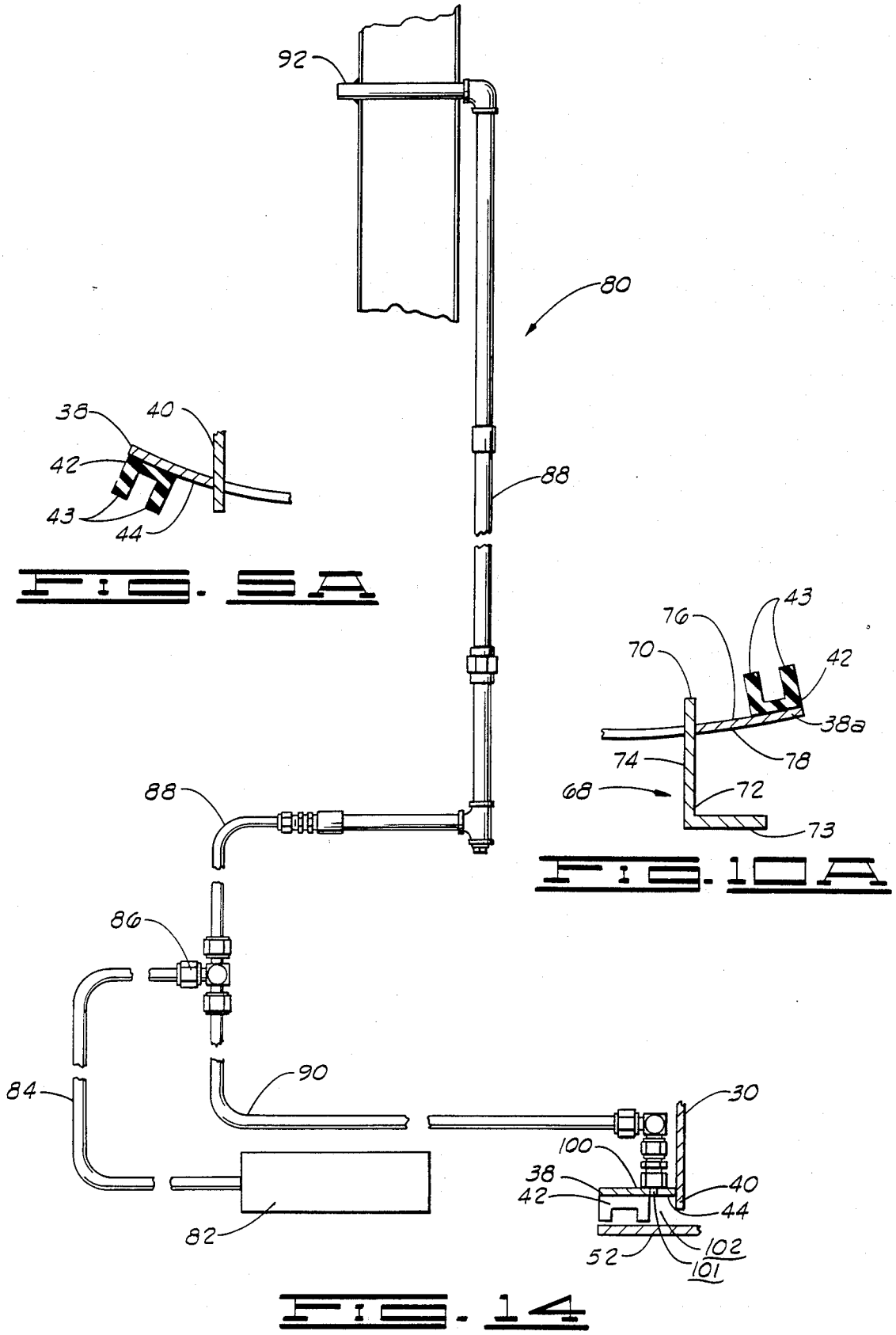
FIG. 5*a* is an enlarged fragmented cross-sectional view of a portion of the structure shown in FIG. 5.
FIG. 10*a* is an enlarged fragmented cross-sectional view of a portion of the structure shown in FIG. 10.
FIG. 14 is a fragmented elevational view of an inert gas injection system.
Figure 5:
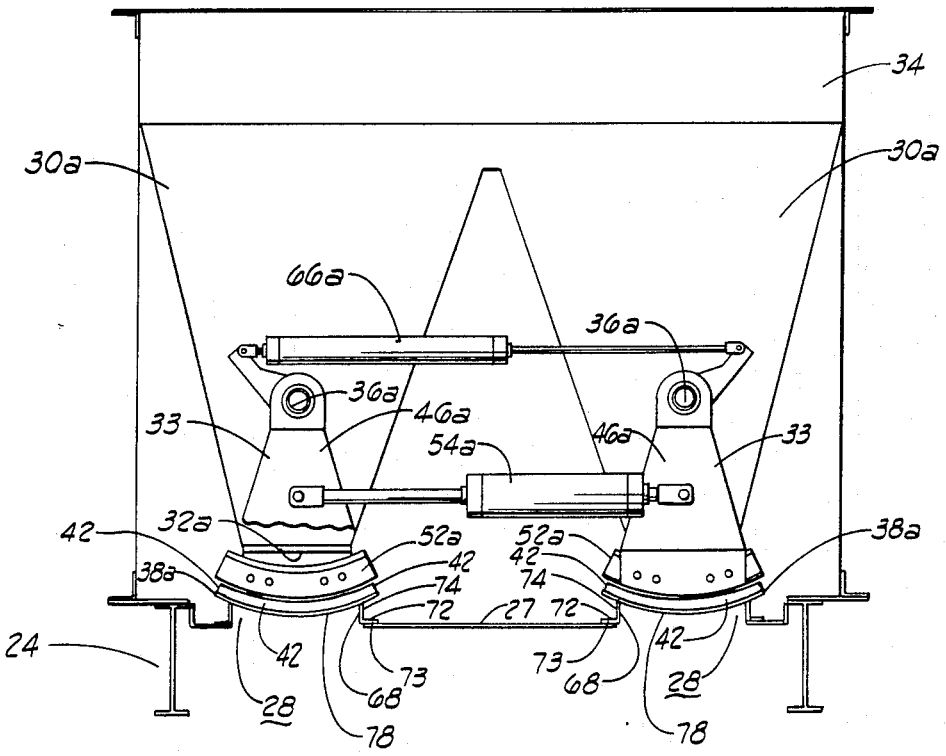
Figure 6:
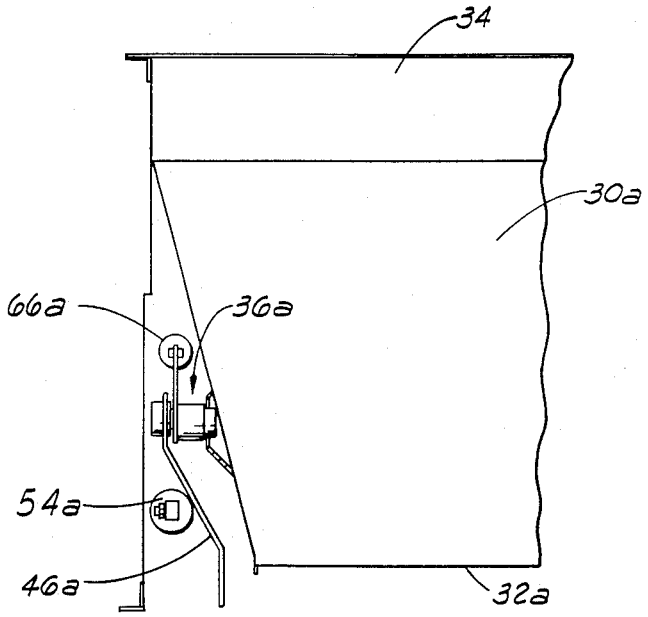

Turning now to FIGS. 2, 5 and 5*a*, each discharge gate assembly 35 is pivotally secured to each hopper 30 by a pair of eccentric assemblies 36, the eccentric assemblies 36 being described in greater detail below. It will be appreciated that a portion of each discharge gate assembly 35 secured to an opposite surface (not shown) of the hopper 30 is identical to the portion of the discharge gate assembly illustrated in FIG. 2.

An external flange 38 is secured to the lower end 40 of each hopper 30, sized for encircling each hopper 30 above the discharge opening 32. An inverted U-shaped deformable seal 42, having depending lips 43, is secured to a lower surface 44 of the flange 38. Such a seal may be obtained from Mechanical Rubber Products, Drawer C/Warwick, N.Y. as part number 313-002010-300. The seal 42, when secured to the surface 44, forms a closed loop encircling the lower end 40 of the hopper 30. The seal 42 is further sized such that the lips 43 extend beyond the discharge opening 32.

Each discharge gate assembly 35 has a pair of gate arms 46 having a lower end 48 and an upper end 50. Each discharge gate assembly 35 also has a gate 52, sized for overlying one of the discharge opening 32. The gate 52 is secured to the lower ends 48 a pair of gate arms 46. Each discharge gate assembly 35 is pivoted under and away from the respective discharge opening 32 by a gate ram 54 secured between the gate 52 and the silo 20.

Figure 3:
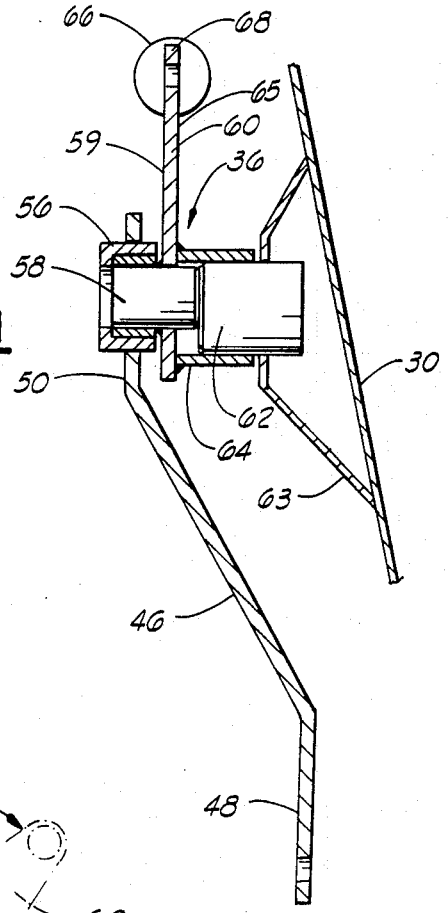
FIG. 3 is an enlarged vertical cross-sectional view of a portion of a silo gate support structure secured to a portion of an eccentric assembly.
Figure 4:
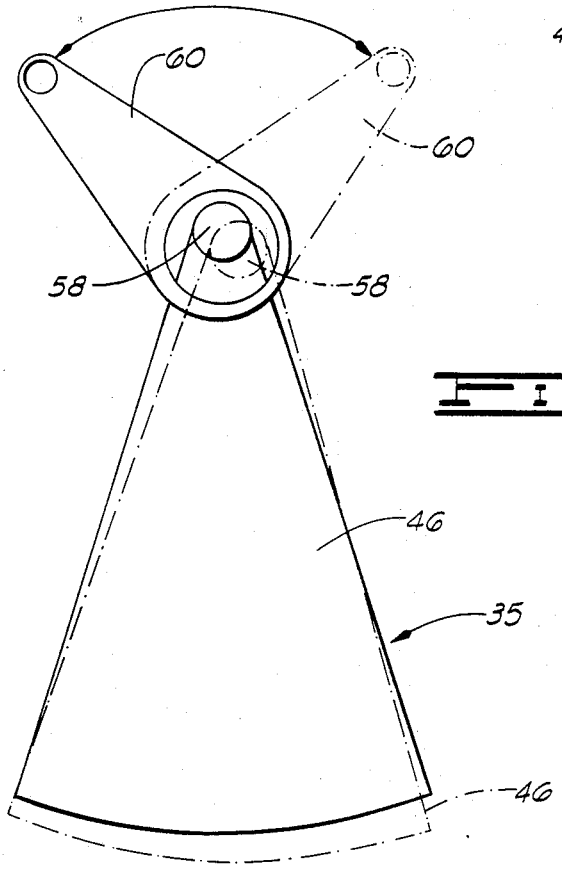
FIG. 4 is a schematic view of a silo gate support structure secured to the eccentric assembly illustrating the range of vertical motion of the silo gate.

Referring now to FIGS. 3–5, the upper end 50 of each gate arm 46 includes a coupler 56 for pivotally securing the respective discharge gate assembly 35 to one of the eccentric assemblies 36. It will be appreciated that an eccentric assembly, identical to the one shown in FIG. 3, is secured to an opposite surface of the hopper 30.

Each eccentric assembly 36 includes an outwardly extending first shaft 58 secured to an outwardly facing side 59 of an arm 60, and a second shaft 62 secured to the hopper 30 by a bracket 63. A sleeve 64, journalled on the second shaft 62 such that the centerlines of the first shaft 58 and the second shaft 62 are offset, is secured to an inwardly facing side 65 of the arm 60 between the arm 60 and the hopper 30.

Each eccentric assembly 36 also includes and eccentric ram 66 secured to an extending end 68 of the arm 60 (FIG. 3). In this way, as illustrated in FIG. 4, the discharge gate assemblies 35 are selectively raised and lowered by pivoting each arm 60 about the respective second shaft 62.

Figure 6:
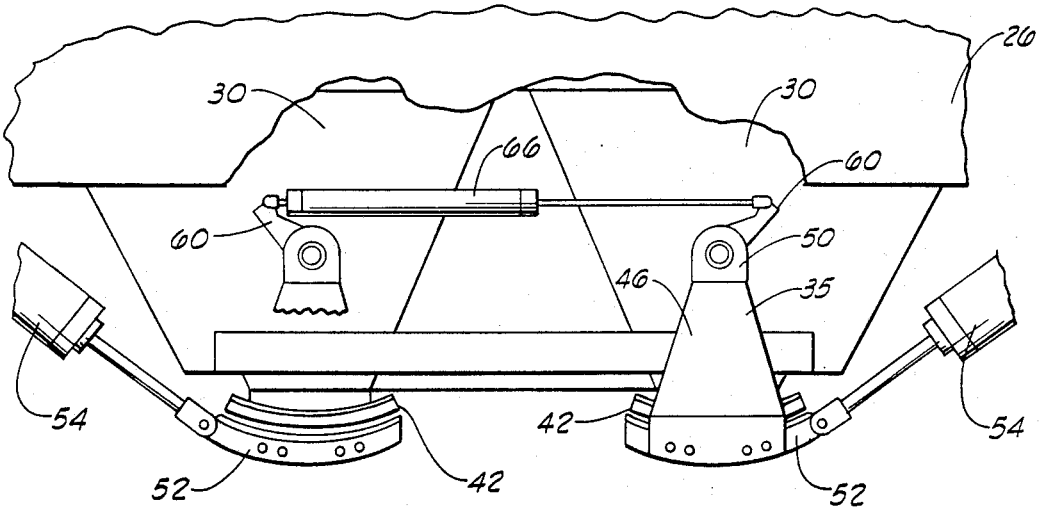
FIG. 6 is the same view as FIG. 5 illustrating the gates in a closed position.
Figure 7:
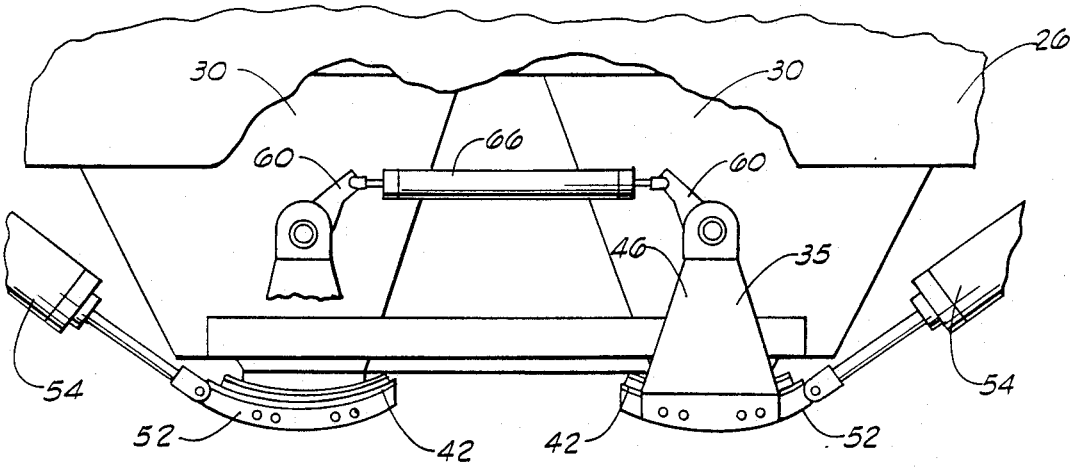
FIG. 7 is the same view as FIG. 5 illustrating the gates in a sealed position.

As shown in FIG. 5–7, the eccentric ram 66 is positioned above each pair of gate arms 46 located on a common side of the silo 20 such that the ends of the eccentric ram are secured to the respective arms 60. In this way, two eccentric rams 66, each eccentric ram 66 being positioned on opposite sides of the hopper, operate in concert to raise and lower the discharge gates 52.

The discharge gate assemblies 35 are selectively positioned in an open position (FIG. 5), a closed position (FIG. 6) and a sealed position (FIG. 7). In the open position, the eccentric rams 66 are expanded to pivot the arms 60 outwardly for lowering the discharge gate assemblies 35 such that each gate 52 is spaced a distance from the respective deformable seal 42. The gate rams 54 are then contracted to pivot the discharge gate assemblies 35 outwardly and away from the discharge openings 32.

In the closed position, the gate rams 54 are expanded to pivot the discharge gate assemblies 35 inwardly and under the discharge openings 32 such that the gates overlie and close the respective discharge openings 32. The eccentric rams 66 remain expanded to maintain the spacing between the gates 52 and the respective deformable seals 42.

In the sealed position, the gate rams 54 remain expanded to maintain the gates 52 in an overlying position with respect to the discharge openings 32. The eccentric rams 66 are then contracted to pivot the arms 60 inwardly for raising the discharge gate assemblies 35 such that the gates 52 compress the deformable seal 42. In this way an air tight seal is formed between the respective gate 52 and the discharge opening 32.

Turning now to FIGS. 8 and 9, the batcher 34 has a pair of flat-sided, side-by-side frustoconical hoppers **30*a*. Each hopper 30*a* has a rectangular discharge opening 32*a* vertically aligned with the respective receiver opening 28. Each discharge opening 32*a* is sized for feeding the composition into the silo 20 through the respective receiver opening 28**.

The receiver gate assemblies 33 are constructed in the same manner as the discharge gate assemblies 35. Each receiver gate assembly 33 includes a pair of gate arms **46*a* and a gate 52*a*. Each receiver gate assembly 33 is pivotally secured to a respective hopper 30*a* by a pair of eccentric assemblies 36*a*. The eccentric assemblies 36*a* are constructed in the same manner as the eccentric assemblies 36, except that the gates 52*a* are raised when a pair of eccentric rams 66*a*, positioned in the same manner as the eccentric rams 66, are expanded, and lowered when the eccentric rams 66*a*** are contracted.

Each receiver gate assembly 33 includes a pair of gate rams **54*a*. Each gate ram 54*a* is secured to the respective gate arms 46*a* located on a common side of the batcher 34. In this way, the rams 54*a* operate in concert to pivot the pair of receiver gate 52*a* under and away from the respective receiver opening 28** (FIGS. 10–12).

The upper floor 27 includes a pair of upwardly extending rectangular collars 68, each having an upper end 70, a lower end 72 and a sidewall 74. Each collar 68 is sized for bordering one of the receiver openings 28. The lower end 72 of each collar 68 includes an outwardly extending horizontal web 73. The horizontal web 73 is secured to the upper floor 27 adjacent the respective receiving openings 28.

As shown in FIG. 10*a*, the collar 68 further includes an external flange **38*a* secured to the sidewall 74 between the upper end 70 and the lower end 72 of the collar 68. The external flange 38*a* has an upper surface 76 and a lower surface 78. The seal 42 is secured to the upper surface 76 of the flange 38 and forms a closed loop for encircling the collar 68. The seal 42 is also sized such that the lips 43 extend above the upper end 70 of the collar 68**.

Figure 10:
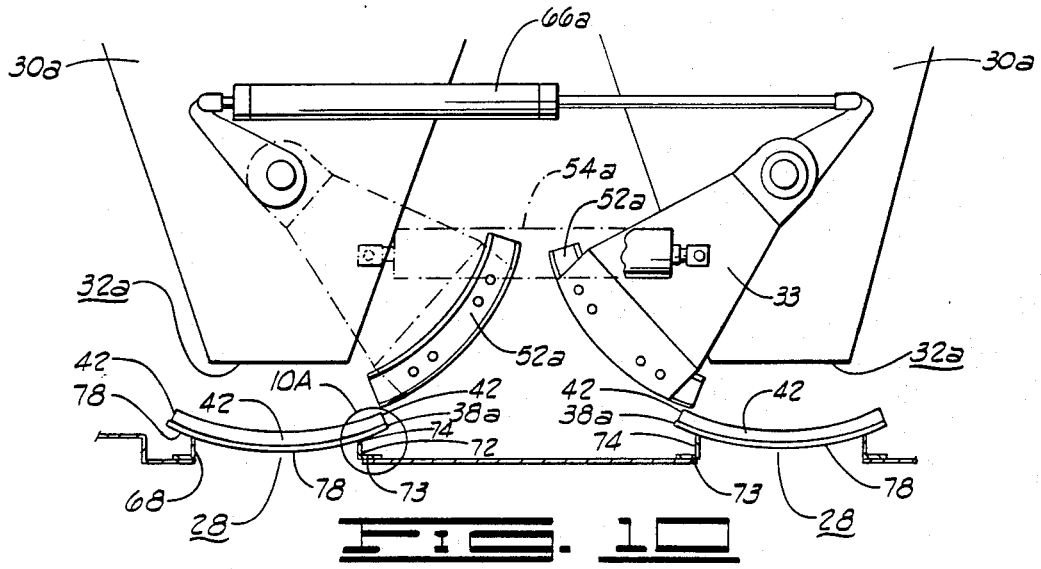
FIG. 10 is a fragmented end elevational view of a pair of receiver gates in an open position with the left hand gate arm broken away for clarity of illustration.
Figure 11:
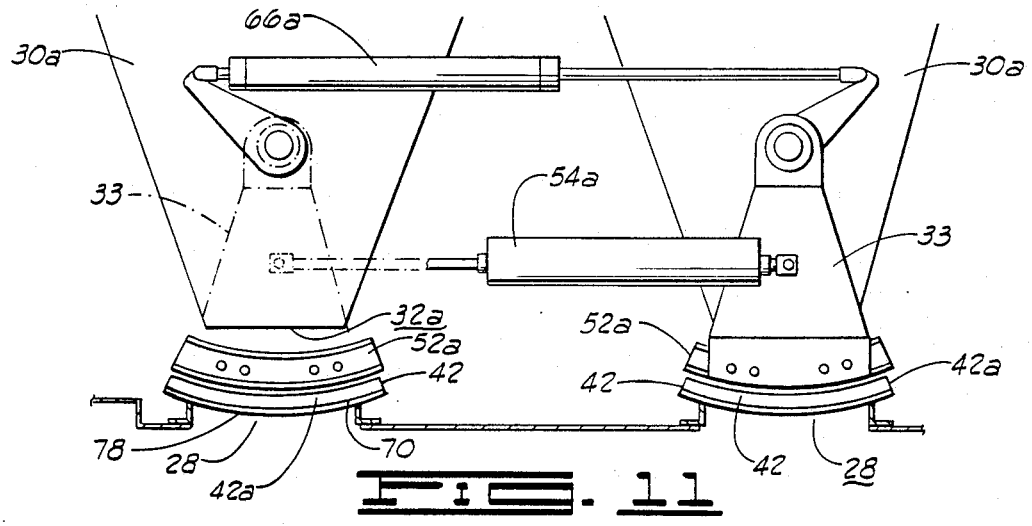
FIG. 11 is the same view as FIG. 10 illustrating the gates in a closed position.
Figure 12:
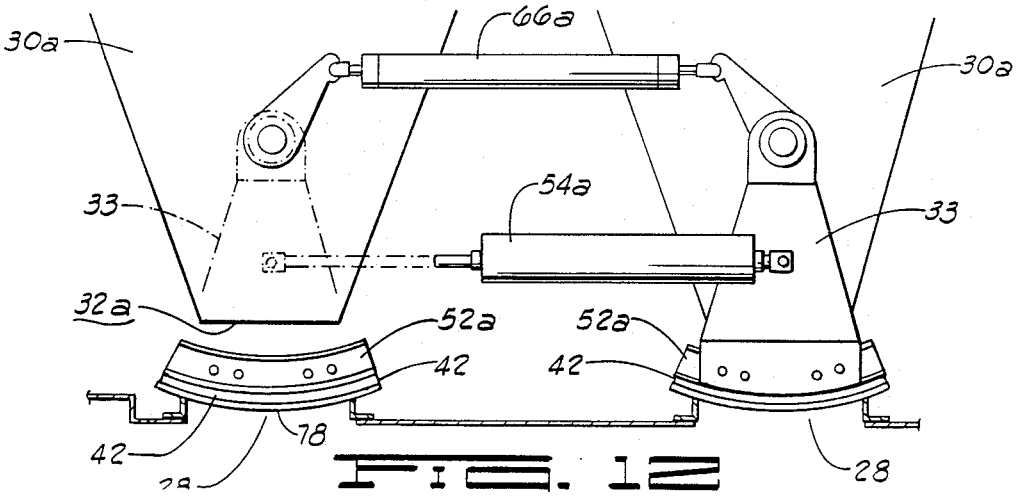
FIG. 12 is the same view as FIG. 10 illustrating the gates in a sealed position.

Referring now to FIGS. 10 through 12, the receiver gate assemblies 33 are selectively positioned in an open position (FIG. 10), a closed position (FIG. 11) and a sealed position (FIG. 12). In the open position, the eccentric rams **66*a* are expanded to pivot the arms 60*a* outwardly for raising the receiver gate assemblies 33. In this way, the gates 52*a* are spaced a distance above the respective deformable seals 42 and a distance below the respective discharge openings 32*a*. The gate rams 54*a* are then contracted to pivot the receiver gate assemblies 33 inwardly and away from the respective receiver openings 28 and the respective discharge openings 32*a***.

In the closed position, the gate rams **54*a* are expanded to pivot the receiver gate assemblies 33 over the receiver openings 28 and under the discharge openings 32*a*. The eccentric rams 66*a* remain expanded to maintain the spacing between the gates 52*a* and the respective deformable seals 42 and the discharge openings 32*a*. In this way, the gates 52*a* overlie the respective receiver openings 28 and the discharge openings 32*a***.

In the sealed position, the gate rams **54*a* remain expanded to maintain the gates 52*a* in an overlying position with respect to the receiver openings 28 and the respective discharge openings 32*a*. The eccentric rams 66*a* are then contracted to pivot the arms 60*a* inwardly for lowering the gate assemblies 33 such that the gates 52*a* compress the deformable seal 42. In this way, an air tight seal is formed between the respective gates 52*a* and the receiver openings 28**.

As shown in FIG. 13, the receiver openings 28 are positioned 90° with respect to the discharge openings 32, such that the receiver openings perpendicularly overlap the discharge openings 32. In this way, the effect of segregation occurring within a composition having a range of particle sizes traveling the length of the silo is reduced and the delivery of a more evenly distributed mixture of the components is achieved.

Figure 15:
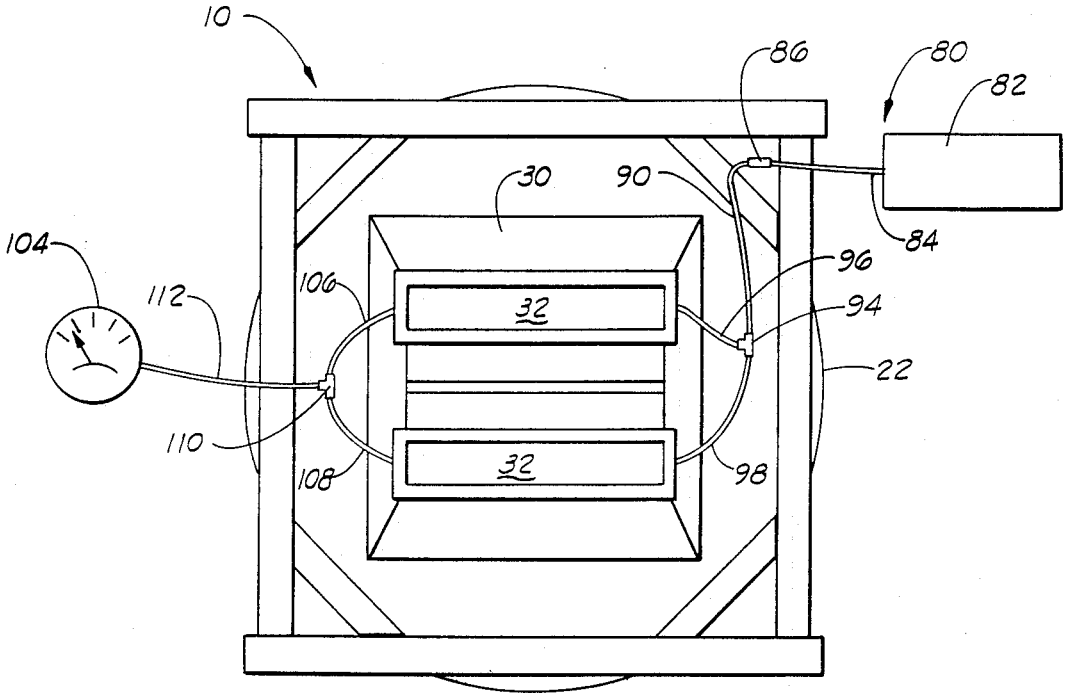
FIG. 15 is a bottom plan view of the silo with the discharge gates removed, illustrating a portion of the inert gas system secured to the discharge end of the silo.

As shown in FIGS. 1, 14 and 15, the silo 10 further includes an inert gas injection system 80. The inert gas system 80 has a pressurized inert gas supply 82 for delivering the inert gas through a conduit 84 to a first conduit tee 86. The flow of inert gas exiting the first conduit tee 86 bifurcates into conduits 88 and 90.

The conduit 88 is secured to the vessel 22 and extends substantially the vertical length thereof. The flow of inert gas entering conduit 88 is injected into the vessel 22 by a plurality of horizontal conduit nipples 92 vertically spaced along the conduit 88.

The flow of inert gas entering conduit 90 is delivered to a second conduit tee 94. The flow of inert gas exiting the second conduit tee 94 bifurcates into conduits 96 and 98. Each of the conduits, 96 and 98, extends to and is secured to an upper surface 100 of one of the external flanges 38. The inert gas exiting each conduit 96 and 98 is injected through an aperture 101 in the respective external flanges 38 and into a cavity 102. The cavity 102 is defined by the deformable seal 42, the lower end 40 of the hopper 30, the lower surface 44 of the flange 38 and the gate 52.

The inert gas injection system 80 further includes a pressure gauge 104 for measuring the inert gas pressure in the cavity 102 when the discharge gate assemblies 35 are in the sealed position (FIG. 7). Conduits 106 and 108 deliver pressurized gas from the respective cavities 102 to a third conduit tee 110. The flow of inert gas exiting the third conduit tee 110 enters the pressure gauge 104 through a conduit 112.

Changes may be made in the construction, operation, and arrangement of the various parts, elements, and procedures described herein without departing from the spirit and scope of the invention as defined in the following claims.

I claim:

1. A silo, comprising:

a vertically extending vessel having a receiver opening at the upper end thereof;

a batcher, having a hopper and a hopper discharge opening, secured to the vessel above the receiver opening, with the receiver opening and the hopper discharge opening vertically aligned;

a gate for selectively closing the receiver opening;

a first shaft secured to the batcher;

at least one gate arm secured to an end of the gate and pivotally secured on the first shaft, said gate arm being positioned external to a flow path formed by said receiver opening and said hopper discharge opening;

means for swinging the gate arm about the first shaft to move the gate alternately over and away from the receiver opening and under and away from the hopper discharge opening;

means for lowering the first shaft and the gate when the gate is over the receiver opening; and a deformable sealing member secured to the vessel around the receiver opening in a position to be engaged by the gate when the gate is lowered to seal off the receiver opening.

2. The silo as defined in claim 1 wherein said means for lowering the first shaft and the gate comprises:

a second shaft secured to the batcher;

an arm, having a inwardly facing side and an outwardly facing side, pivotally secured to the second shaft and secured to the first shaft in a position whereby the centerlines of the first shaft and the second shaft are offset; and means for pivoting the arm such that the first shaft is selectively lowered.

3. The silo as defined in claim 2 wherein said means for lowering the first shaft comprises:

a sleeve journalled on the second shaft, with the end of the sleeve extending away from the batcher secured to the inwardly facing side of the arm, and the first shaft secured to the outwardly facing side of the arm.

4. The silo defined in claim 1 wherein said means for swinging the gate arm comprises:

a ram secured to the gate arm.

5. The silo defined in claim 2 wherein said means for pivoting the arm comprises:

a ram secured to the arm.

6. The silo as defined in claim 1 further comprising:

a collar having a lower end, an upper end and a side wall, wherein the lower end is secured to the vessel around the receiver opening, and wherein the upper end extends above the receiver opening;

a flange, having an upper surface and a lower surface, outwardly extending from the side wall of the collar between the upper end and the lower end of the collar;

the deformable sealing member secured to the upper surface of the flange, with the deformable sealing member extending above the upper end of the collar in the path of movement of the gate so that when the gate is lowered the deformable sealing member is compressed between the gate and the flange.

7. A silo for a composition comprising:

a vertically extending vessel having a receiver opening at the upper end thereof, said receiver opening having a vertically extending central axis;

a gate for selectively closing the receiver opening;

a first shaft secured to the vessel above the receiver opening;

at least one gate arm secured to the edge of the gate and pivotally secured on the first shaft, said gate arm being positioned external to a flow of composition flowing along said axis into said receiver opening;

means for swinging the gate arm about the first shaft to move the gate alternately over and away from the receiver opening;

means for lowering the first shaft and the gate when the gate is over the receiver opening; and a deformable sealing member secured to the vessel around the receiver opening in a position to be engaged by the gate when the gate is lowered to seal off the receiver opening.

8. The silo as defined in claim 7 wherein said means for lowering the first shaft and the gate comprises:

a second shaft secured to the silo;

an arm, having an inwardly facing side and an outwardly facing side, pivotally secured on the second shaft and secured to the first shaft in a position whereby the centerlines of the first shaft and the second shaft are offset; and means for pivoting the arm such that the first shaft is selectively lowered.

9. The silo as defined in claim 8 wherein said means for lowering the first shaft further comprises:

a sleeve journalled on the second shaft, wherein the end of the sleeve extending away from the vessel is secured to the inwardly facing side of the arm, and wherein the first shaft is secured to the outwardly facing side of the arm.

10. The silo defined in claim 7 wherein said means for swinging the gate arm comprises:

a ram secured to the gate arm.

11. The silo defined in claim 8 wherein said means for pivoting the arm comprises:

a ram secured to the arm.

* * * * *